US006019797A

United States Patent [19]

Del Duca et al.

[11] Patent Number: 6,019,797

[45] Date of Patent: Feb. 1, 2000

[54] LAUNDRY BLEACHING WITH IMPROVED SAFETY TO FABRICS

[75] Inventors: Valerio Del Duca, Massa Lubrense; Stefano Scialla; Giulia Ottavia Bianchetti, both of Rome, all of Italy

[73] Assignee: Procter & Gamble Company, Cincinnati, Ohio

[21] Appl. No.: 09/202,247

[22] PCT Filed: Jun. 6, 1997

[86] PCT No.: PCT/US97/09965

§ 371 Date: Feb. 26, 1999

§ 102(e) Date: Feb. 26, 1999

[87] PCT Pub. No.: WO97/47800

PCT Pub. Date: Dec. 18, 1997

[30] Foreign Application Priority Data

Jun. 10, 1996 [EP] European Pat. Off. ..... 96870074

[51] Int. Cl.[7] ..... C11D 3/39; D06L 3/02

[52] U.S. Cl. ..... 8/111; 252/186.42; 252/186.43; 510/302; 510/303; 510/309; 510/311

[58] Field of Search ..... 8/111, 303, 309, 8/367, 370, 372; 252/186.42, 186.43; 510/302, 303, 309, 311

[56] References Cited

U.S. PATENT DOCUMENTS

| | | | |
|---|---|---|---|
| 2,757,207 | 7/1956 | Lorand et al. | 568/568 |
| 3,574,519 | 4/1971 | Lincoln et al. | 8/111 |
| 3,746,646 | 7/1973 | Bioxader | 510/309 |
| 3,753,915 | 8/1973 | Demangeon et al. . | |
| 3,982,892 | 9/1976 | Gray et al. | 8/111 |
| 5,281,361 | 1/1994 | Adams et al. . | |
| 5,284,597 | 2/1994 | Rees et al. . | |
| 5,314,635 | 5/1994 | Hage et al. | 510/376 |

FOREIGN PATENT DOCUMENTS

| | | |
|---|---|---|
| 812907 | 12/1997 | European Pat. Off. . |
| 680623 | 10/1952 | United Kingdom . |
| WO 92/17634 | 10/1992 | WIPO . |

*Primary Examiner*—Alan Diamond
*Attorney, Agent, or Firm*—C. Brant Cook; Kim W. Zerby; Jacobus C. Rasser

[57] ABSTRACT

Stains are removed from fabrics by means of metallo-hydroperoxides during an otherwise conventional laundering process. Hydroperoxides based on silicon, tin and antimony are used to effect stain removal without reducing the tensile strength of said fabrics.

3 Claims, No Drawings

LAUNDRY BLEACHING WITH IMPROVED SAFETY TO FABRICS

This application is a 371 of PCT/US97/09965 filed Jun. 6, 1997.

TECHNICAL FIELD

The present invention relates to the bleaching of fabrics.

BACKGROUND

Peroxygen bleach-containing compositions have been described in laundry applications as laundry detergents, laundry additives or even laundry pretreaters.

Indeed, it is known to use peroxygen bleach-containing compositions in laundry treatment applications to boost the removal of encrustated stains/soils which are otherwise particularly difficult to remove, such as grease, coffee, tea, grass, mud/clay-containing soils and the like. However, we have found that a drawback associated with such peroxygen bleach-containing compositions is that said compositions may damage fabrics, resulting in loss of tensile strength, especially when used in pretreatment application, i.e. when applied directly (neat) onto the fabrics, and left to act onto said fabrics for prolonged periods of time before washing the fabrics.

It is thus an object of the present invention to provide improved fabric safety upon bleaching, especially in pretreatment applications where the compositions are left neat into contact with the fabrics for prolonged periods of time before washing.

Indeed, when bleaching fabrics with a composition comprising a peroxygen bleach like hydrogen peroxide, it has been found that the presence of metal ions such as copper and/or iron and/or manganese and/or chromium on the surface of the fabrics and/or the exposure to UV radiation from sunlight of the fabrics after having been contacted with the peroxygen bleach-containing composition, produces fabric damage resulting in loss of tensile strength of the fabric fibres. Indeed, it is speculated that the presence of metal ions such as copper and/or iron and/or manganese and/or chromium on the surface of the fabrics, especially on cellulosic fibres, and/or the exposure of the fabrics to UV radiation from sunlight catalyses the radical decomposition of peroxygen bleaches like hydrogen peroxide. Thus, it is believed that a radical reaction occurs on the surface of the fabric with generation of free radicals, which results in loss of tensile strength.

It has now been found that improved fabric safety can be achieved by formulating a bleaching composition where hydrogen peroxide is substituted by selected hydroperoxides as the bleaching agent, or mixtures thereof.

U.S. Pat. No. 5,284,597 discloses a composition for treating soft surfaces, essentially carpets, which comprise amongst other things tertiary alkyl hydroperoxide. The compositions are said to be safer to colors.

U.S. Pat. No. 3,574,519 discloses the bleaching of textiles where the bleaching agent is an organic hydroperoxide. Organic hydroperoxides are said to be economically attractive. '519 does not discuss the problem of safety to fabrics.

BE 831.277 discloses the bleaching of textiles with the help of a mixtures of bleach activators, one of which being from the class of triazine hydroperoxides. Triazine hydroperoxides are said to be potentially damaging to the colors of fabrics. '277 does not discuss the problem of safety to fabrics.

U.S. Pat. No. 3,753,915 discloses the bleaching of fabrics with a granular composition comprising salts of hydroperoxides. '915 does not discuss the problem of safety to fabrics.

SUMMARY OF THE INVENTION

In its broadest embodiment, the present invention encompasses the use of hydroperoxides for the bleaching of fabrics, for reducing the loss of tensile strength in said fabrics.

The present invention further encompasses processes of bleaching fabrics, starting from a liquid composition comprising a hydroperoxide. The processes include the steps of contacting said fabrics with the liquid bleaching composition neat or diluted, and subsequently rinsing said fabrics. In the preferred embodiment, when the fabrics are "pretreated", the composition is applied neat on the fabrics, and the fabrics are subsequently washed in a normal wash cycle.

DETAILED DESCRIPTION OF THE INVENTION

In its broadest embodiment, the present invention encompasses the use of a hydroperoxide as a bleaching agent in a process of bleaching fabrics for reducing the loss of tensile strength in said fabrics.

In other words, the present invention is based on the finding that fabric damage resulting in tensile strength loss is reduced, when a composition comprising a hydroperoxide, or mixtures thereof, is used to bleach fabrics, as compared to the same composition where hydrogen peroxide is used instead of hydroperoxide.

It is speculated that reduced fabric damage observed herein is due to the much lower reactivity of free radicals generated from hydroperoxides vs. those generated from hydrogen peroxide.

In addition, it is speculated that with hydroperoxides, there is a lower dependence of fabric damage from heavy metal pollution, probably because the formation of a complex between the metal and the peroxide molecule is more difficult than with hydrogen peroxide.

The tensile strength in a fabric may be measured by stretching said fabric until it breaks. The force needed to break the fabric is the "Ultimate Tensile Stress" and may be measured with a stress-strain INSTRON® machine available from INSTRON. The loss of tensile strength is the difference between the tensile strength of a fabric taken as a reference, i.e. a fabric which has not been bleached, and the tensile strength of the same fabric after having been bleached. A tensile strength loss of zero means that no fabric damage is observed.

As a first essential element, the liquid compositions suitable to be used according to the present invention comprise a hydroperoxide, or mixtures thereof, as the bleaching agent. Suitable hydroperoxides for use herein include alkyl hydroperoxides and organomineral hydroperoxides.

Suitable alkyl hydroperoxides for use herein are according to the formula

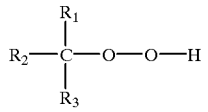

in which each R1, R2 and R3 is, independently, a hydrogen atom or a hydrocarbon radical having from 1 to 30 carbon atoms. The hydrocarbon radical can be a linear or a cyclic hydrocarbon chain, and the linear and the cyclic hydrocarbon chain can be straight or branched, saturated or unsaturated. Also, two of the R groups can be part of the same cyclic hydrocarbon. One or more R groups in the above formula can be a single or condensed aromatic radical, alkyl-aryl radical or cycloalkyl-aryl radical.

All the above R radicals can also be substituted by heteroatoms or group of heteroatoms, such as hydroperoxide (—OOH) groups, halogen atoms, hydroxy groups, nitrates, suphonyls, nitro groups, ethers, carboxylic groups and esters. All these groups can also be present as substituents of one or more positions of the R radicals.

Preferred alkyl hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide.

Suitable organomineral hydroperoxides for use herein are according to the formula $$R_mM(OOH)_n$$

where M is a metal atom like Si, Sn, Ge or Sb and R is a radical defined as R1, R2, R3 above. Preferred organomineral hydroperoxides for use herein are $(CH_3)_3SiOOH$, $(C_6H_5)_2CH_3SiOOH$, $(C_6H_5)_3SiOOH$, $(n\text{-}C_6H_{13})_3SiOOH$, $(CH_3)_3SnOOH$, $(C_6H_5)_3Sb(OOH)_2$. Most preferred for use herein are $(CH_3)_3SiOOH$, $(C_6H_5)_3SiOOH$.

Typically, the compositions herein comprise from 0.01% to 5.0%, preferably 0.015% to 4.0%, most preferably from 0.02% to 2.0% of available oxygen provided by said hydroperoxide.

The compositions to be used according to the present invention must be liquids. As used herein, "liquid" includes "pasty" compositions, and liquid compositions herein preferably have a viscosity of from 5 cps to 10000 cps at 50 rpm shear rate and at 20° C. temperature.

Preferably, the compositions to be used herein are aqueous. Said aqueous compositions have a pH as is of from 2 to 11, preferably from 3 to 10 and more preferably from 3.5 to 9.5 when optimum chemical stability for the hydroperoxides has been observed. The pH of the compositions can be adjusted for instance by using organic or inorganic acids, or alkalinizing agents.

The compositions used in the present invention may further comprise any surfactant including nonionic, anionic, cationic, zwitterionic and/or amphothereic surfactants.

Accordingly, the compositions used in the present invention preferably further comprise a nonionic surfactant, or mixtures thereof. Typically, the compositions used in the present invention comprise from 0.1% to 50% by weight of the total composition of said nonionic surfactant, or mixtures thereof, preferably from 0.3% to 30% and more preferably from 0.4% to 25%.

Suitable nonionic surfactants to be used herein are fatty alcohol ethoxylates and/or propoxylates which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation. Surfactant catalogues are available which list a number of surfactants, including nonionics, together with their respective HLB values.

Suitable chemical processes for preparing the nonionic surfactants for use herein include condensation of corresponding alcohols with alkylene oxide, in the desired proportions. Such processes are well known to the man skilled in the art and have been extensively described in the art. As an alternative, a great variety of alkoxylated alcohols suitable for use herein is commercially available from various suppliers.

Particularly suitable to be used herein as nonionic surfactants are hydrophobic nonionic surfactants having an HLB (hydrophilic-lipophilic balance) below 16, preferably below 15, more preferably below 12, and most preferably below 10. Those hydrophobic nonionic surfactants have been found to provide good grease cutting properties.

Preferred hydrophobic nonionic surfactants to be used in the compositions according to the present invention are surfactants having an HLB below 16 and being according to the formula $RO—(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0 to 20 and n is from 0 to 15 and m is from 0 to 20, preferably n+m is from 1 to 15 and, n and m are from 0.5 to 15, more preferably n+m is from 1 to 10 and, n and m are from 0 to 10. The preferred R chains for use herein are the $C_8$ to $C_{22}$ alkyl chains. Accordingly suitable hydrophobic nonionic surfactants for use herein are Dobanol® 91-2.5 (HLB=8.1; R is a mixture of $C_9$ and $C_{11}$ alkyl chains, n is 2.5 and m is 0), or Lutensol® TO3 (HLB=8; R is a $C_{13}$ alkyl chains, n is 3 and m is 0), or Lutensol® AO3 (HLB=8; R is a mixture of $C_{13}$ and $C_{15}$ alkyl chains, n is 3 and m is 0), or Tergitol® 25L3 (HLB-= 7.7; R is in the range of $C_{12}$ to $C_{15}$ alkyl chain length, n is 3 and m is 0), or Dobanol® 23-3 (HLB=8.1; R is a mixture of $C_{12}$ and $C_{13}$ alkyl chains, n is 3 and m is 0), or Dobanol® 23-2 (HLB=6.2; R is a mixture of $C_{12}$ and $C_{13}$ alkyl chains, n is 2 and m is 0), or Dobanol® 45-7 (HLB=11.6; R is a mixture of $C_{14}$ and $C_{15}$ alkyl chains, n is 7 and m is 0) Dobanol® 23-6.5 (HLB=11.9; R is a mixture of $C_{12}$ and $C_{13}$ alkyl chains, n is 6.5 and m is 0), or Dobanol® 25-7 (HLB=12; R is a mixture of $C_{12}$ and $C_{15}$ alkyl chains, n is 7 and m is 0), or Dobanol® 91-5 (HLB=11.6; R is a mixture of $C_9$ and $C_{11}$ alkyl chains, n is 5 and m is 0), or Dobanol® 91-6 (HLB=12.5 ; R is a mixture of $C_9$ and $C_{11}$ alkyl chains, n is 6 and m is 0), or Dobanol® 91-8 (HLB=13.7 ; R is a mixture of $C_9$ and $C_{11}$ alkyl chains, n is 8 and m is 0), Dobanol® 91-10 (HLB =14.2 ; R is a mixture of $C_9$ to $C_{11}$ alkyl chains, n is 10 and m is 0), or mixtures thereof. Preferred herein are Dobanol® 91-2.5, or Lutensol® TO3, or Lutensol® AO3, or Tergitol® 25L3, or Dobanol® 23-3, or Dobanol® 23-2, or mixtures thereof. These Dobanol® surfactants are commercially available from SHELL. These Lutensol® surfactants are commercially available from BASF and these Tergitol® surfactants are commercially available from UNION CARBIDE.

Preferred compositions to be used herein further comprise an anionic surfactant, or mixtures thereof. Said anionic surfactants act as wetting agent, i.e. in laundry application they wet the stains on the fabrics, especially on hydrophilic fabrics, and thus help the hydroperoxide perform its bleaching action thereby contributing to improved laundry performance on bleachable stains. Furthermore, anionic surfactants allow to obtain clear compositions even when said compositions comprise hydrophobic ingredients such as hydrophobic surfactants. Typically, the compositions to be used herein comprise from 0.1% to 20% by weight of the total composition of said anionic surfactant, or mixtures thereof, preferably from 0.2% to 15% and more preferably from 0.5% to 13%.

Particularly suitable for use herein are sulfonate and sulfate surfactants. The like anionic surfactants are well-known in the art and have found wide application in commercial detergents. These anionic surfactants include the C8–C22 alkyl benzene sulfonates (LAS), the C8–C22 alkyl sulfates (AS), unsaturated sulfates such as oleyl sulfate, the C10–C18 alkyl alkoxy sulfates (AES) and the C10–C18 alkyl alkoxy carboxylates. The neutralising cation for the anionic synthetic sulfonates and/or sulfates is represented by conventional cations which are widely used in detergent technology such as sodium, potassium or alkanolammonium. Preferred herein are the alkyl sulphate, especially coconut alkyl sulphate having from 6 to 18 carbon atoms in the alkyl chain, preferably from 8 to 15, or mixtures thereof.

The compositions for use herein may further comprise a foam suppressor such as 2-alkyl alkanol, or mixtures thereof, as a highly preferred optional ingredient. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the $\alpha$ position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol). Typically, the compositions suitable to be used herein comprise from 0.05% to 2% by weight of the total composition of a 2-alkyl alkanol, or mixtures thereof, preferably from 0.1% to 1.5% and most preferably from 0.1% to 0.8%.

The compositions herein may further comprise a variety of other optional ingredients such as builders, stabilisers, chelants, soil suspenders, dye transfer agents, radical scavengers, solvents, brighteners, perfumes, and dyes.

In the present invention, the liquid bleaching composition comprising the hydroperoxide needs to be contacted with the fabrics to be bleached. This can be done either in a so-called "pretreatment mode", where the composition is applied neat onto said fabrics before the fabrics are rinsed, or washed then rinsed, or in a "soaking mode" where the liquid composition is first diluted in an aqueous bath and the fabrics are immersed and soaked in the bath, before they are rinsed, or in a "through the wash mode", where the liquid composition is added on top of a wash liquor formed by dissolution or dispersion of a typical laundry detergent. As discussed earlier, the composition to perform the processes herein is in the form of a liquid as opposed to a solid or a gas.

It is also essential in both cases, that the fabrics be rinsed after they have been contacted with said composition, before said composition has completely dried off.

Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabric, in a process of pretreating soiled fabrics, contributes to the benefits according the present invention, i.e. to reduce the tensile strength loss when pretreating fabrics with liquid peroxygen bleach-containing compositions.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a period of time ranging from 1 min. to 1 hour, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking", the process comprises the steps of diluting said liquid composition in its neat form in an aqueous bath so as to form a diluted composition, i.e., a composition comprising from 0.0001% to 0.2%, preferably 0.0002% to 0.02% of available oxygen provided by said hydroperoxide. The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 30 minutes to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

Depending on the end-use envisioned, the compositions herein can be packaged in a variety of containers including conventional bottles, bottles equipped with roll-on, sponge, brusher or sprayers, or sprayers.

The invention is further illustrated by the following examples.

EXAMPLES

Example 1

A liquid composition is prepared which comprises:

| | |
|---|---|
| Cumyl Hydroperoxide | 10% |
| Dobanol 23.3 | 8.6% |
| Dobanol 45.7 | 6.4% |
| C12 Alkyl Sulfate | 2% |
| Water and minors | up to 100% |

pH = 4, trimmed with Sulphuric acid

In a pretreatment mode, this composition is applied neat on the stained portion of a fabric and left to act thereon for 5 minutes. Then the fabric is washed with a conventional detergent and rinsed.

Example 2

The following liquid composition is prepared:

| | |
|---|---|
| tert-Butyl Hydroperoxide | 10% |
| Dobanol 45.7 | 6.0% |
| Dobanol 23.6,5 | 6.0% |
| C25-AE2.5-S (ethoxylated alkyl sulfate) | 6.0% |
| Water and minors | up to 100% |

pH = 4, trimmed with Sulphuric acid

In a bleaching-through-the-wash mode, this composition is contacted with an aqueous bath formed by dissolution of a conventional detergent in water. Fabrics are then contacted with the aqueous bath comprising the liquid detergent, and the fabrics are rinsed. This composition can also be used in a pretreatment mode, where it is poured neat on the stains on the fabrics, and left to act for 5 minutes, and the fabrics are washed.

Example 3

The following liquid composition is prepared:

| | |
|---|---|
| tert-Butyl Hydroperoxide | 5% |
| Dobanol 91.10 | 1.6% |
| Dobanol 23.3 | 1.5% |
| C10 AS | 1.7% |
| Isofol 12 ® | 0.5% |
| Water and minors | up to 100% |

pH = 4, trimmed with Sulphuric acid

This composition can be used in a pretreatment mode, or in a bleaching-through-the-wash mode, as described in examples 1 and 2. It can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed.

Example 4

A liquid detergent composition is prepared as follows:

| | |
|---|---|
| Cumyl Hydroperoxide | 10% |
| Dobanol 23.3 | 8.6% |

-continued

| | |
|---|---|
| Dobanol 45.7 | 6.4% |
| C12 AS | 2% |
| Water and minors | up to 100% |

pH = 6, trimmed with Sulphuric acid

This composition is used in a pretreatment mode, as described in the examples above.

Example 5

The following liquid composition is made:

| | |
|---|---|
| 2,5-dimethyl-hexane-2,5-dihydroperoxide | 5% |
| Dobanol 23.3 | 8.6% |
| Dobanol 45.7 | 6.4% |
| C25-2.5EO-S | 2% |
| Water and minors | up to 100% |

pH = 5, trimmed with Sulphuric acid

This composition is used in a pretreatment mode as described in the previous examples.

We claim:

1. A process of bleaching fabrics comprising contacting said fabrics with a hydroperoxide which is a member selected from the group consisting of $(CH_3)_3SiOOH$, $(C_6H_5)_2$ $CH_3SiOOH$, $(C_6H_5)_3SiOOH$, $(n\text{-}C_6H_{13})_3SiOOH$, $(CH_3)_3$ SnOOH and $(C_6H_5)_3Sb(OOH)_2$ subsequently rinsing said fabrics.

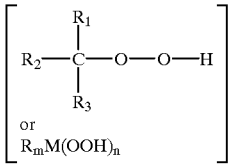

2. The process according to claim 1, wherein the fabrics are left in contact with said hydroperoxide for a period of time ranging from 30 minutes to 48 hours.

3. The process according to claim 1 which is conducted with said hydroperoxide and a conventional laundry detergent in water.

* * * * *